United States Patent [19]

Davies et al.

[11] 3,957,508

[45] May 18, 1976

[54] ELECTRICAL CONTACT MATERIALS

[75] Inventors: Terrence Ardern Davies, Horton; Peter John Swallow, Blisworth, both of England

[73] Assignee: Square D Company, Park Ridge, Ill.

[22] Filed: Mar. 17, 1975

[21] Appl. No.: 558,755

Related U.S. Application Data

[62] Division of Ser. No. 379,512, July 16, 1973, Pat. No. 3,893,821.

[30] Foreign Application Priority Data

July 18, 1973 United Kingdom ..... 33656/73

[52] U.S. Cl. ..... 75/206

[51] Int. Cl.[2] ..... B22F 1/00; B22F 3/00

[58] Field of Search ..... 75/206; 24/182.5; 423/595, 596, 263; 252/521, 514

[56] References Cited

UNITED STATES PATENTS

| | | | |
|---|---|---|---|
| 3,385,677 | 5/1968 | Schreiner | 252/514 |
| 3,506,437 | 4/1970 | Gwyn, Jr. | 75/206 |
| 3,630,968 | 12/1971 | Hahano | 252/521 |

*Primary Examiner*—Leland A. Sebastian
*Assistant Examiner*—R. E. Schafer
*Attorney, Agent, or Firm*—Harold J. Rathbun; Roger J. Falkowski

[57] ABSTRACT

The material consists of a mixture of silver and 1.0 to 20 weight per cent of lanthanum, strontium chromite of the formula $La_{1-x}Sr_xCrO_3$, where the values of x lie between 0 and 1.0. The addition of 2.5 to 20 weight per cent of cadmium oxide further improves the electrical contact material by providing anti-weld properties to the contact interface. The electrical contacts are formed from the contact material by powder metallurgy techniques.

26 Claims, No Drawings

ELECTRICAL CONTACT MATERIALS

This is a division, of application Ser. No. 379,512, filed July 16, 1973 now U.S. Pat. No. 3,893,821.

The invention relates to electrical contact materials for use in electrical contacts and to methods of producing the electrical contact materials.

It is an object of the present invention to provide an electrical contact with prolonged reliable continuity of electrical conductivity across the interface between its contact surface and the metal surface it is contacting under all environmental conditions.

Another object is to provide an electrical contact material which consists of a mixture of silver and 1.0 to 20 weight per cent of lanthanum, strontium chromite of formula $La_{1-x}Sr_xCrO_3$, where the values of $x$ lie between 0 and 1.0, formed as a hard chemically inert, non-metallic phase of high electrical conductivity both within the bulk of, and at the surface of, the contact material.

A further object is to provide an electrical contact material, as outlined in the preceding paragraph, which includes 2.5 to 20 weight per cent of cadmium oxide.

An additional object is to provide a method of producing an electrical contact material including the steps of providing irregular silver powder having a powder particle size of not greater than approximately 350 British Standard mesh (45 microns); providing lanthanum, strontium chromite powder of formula $La_{1-x}Sr_xCrO_3$, where the values of $x$ lie between 0 and 1.0, and preferably having a powder particle size of not greater than approximately 10 microns; mixing the powders together to provide a fine, evenly dispersed mixture containing 1.0 to 20 weight per cent of $La_{1-x}Sr_xCro_3$ and the remainder silver; compacting the powder mixture into a desired shape; and sintering the compacted shape.

A still further object is to provide a method as outlined in the preceding object which includes, prior to the compacting and sintering steps, the steps of providing 2.5 to 20 weight per cent of cadmium oxide powder having a powder particle size of not greater than approximately 1 micron; and mixing the cadmium oxide powder with the silver powder and the $La_{1-x}Sr_xCrO_3$ powder to provide a fine, evenly dispersed mixture.

The foregoing and other features according to the invention will be better understood from the following description of specific embodiments of the invention.

An electrical contact material according to the invention which is especially adapted for medium to light duty applications consists of a mixture of silver and 1.0 to 20 weight per cent of lanthanum, strontium chromite of formula $La_{1-x}Sr_xCrO_3$ where the values of $x$ lie between 0 and 1.0. The $La_1Sr_xCrO_3$ forms as a hard, chemically inert, non-metallic phase of high electrical conductivity both within the bulk of, and at the surface of, the contact material.

The $La_{1-x}Sr_xCrO_3$ non-metallic phase which is present in the contact material as a fine dispersion of discrete particles, the mean particle size not exceeding approximately 10 microns, possess the following properties:

a. The phase has a high electrical conductivity, i.e., a specific resistivity within the range 1 to $10^{-3}$ohm-centimeters.

b. The phase is thermodynamically stable with respect to the environment and the matrix metal or alloy.

c. The phase possesses high thermal stability in order to withstand thermal treatments likely to occur during the fabrication of the contact piece part.

d. The phase is chemically inert.

e. The phase is harder than the tarnish films likely to form on the matrix metal or alloy; for example, oxide or sulphide films.

The $La_{1-x}Sr_xCrO_3$ non-metallic phase, will, therefore, form as a hard, chemically inert, non-metallic phase of high electrical conductivity both within the bulk of, and at the surface of, the contact material.

The presence of the highly conductive, non-metallic phase at the surface of electrical contacts fabricated from the electrical contact material according to the invention effectively minimizes the increase in contact resistance by providing highly conductive paths across the contacting interface.

Also tarnish films which may form on the silver will be disrupted by the harder, chemically inert, non-metallic phase at the contact surface so that electrical contact is maintained; the discrete islands of highly conductive, non-metallic material effectively constitute anisotropic conducting paths through the otherwise electrically insulating tarnish film formed on the surrounding material.

Cadmium oxide can be added to the electrical contact material outlined in the preceding paragraphs to a concentration in the range 2.5 to 20 weight per cent. The cadmium oxide effects embrittlement of the welds which tend to form when contact is established between electrical contacts. Also, the cadmium vapor that will be present in the arc which occurs when contact between electrical contacts fabricated from this silver based material is broken, acts so as to reduce the mean electron energies in the arc and change the distribution of electron energies in the arc to eliminate the high energy electrons.

The electrical contact materials according to the invention can be fabricated by any one of several known techniques but are best fabricated by powder metallurgical techniques.

In a method according to the invention for producing an electrical contact material which consists of silver and $La_{1-x}Sr_xCrO_3$, fine, irregular silver powder is intimately mixed with $La_{1-x}Sr_xCrO_3$ powder to provide a fine, evenly dispersed mixture containing 1.0 to 20 weight per cent of the non-metallic $La_{1-x}Sr_xCrO_3$ powder, and the remainder silver.

The size and shape of the powder particles are of prime importance in the manufacture of optimum contact materials and all the powders should preferably be as fine as is economically possible. This in practice involves the use of irregular silver powder having a powder particle size of less than approximately 350 British Standard mesh and $La_{1-x}Sr_xCrO_3$ powder having a powder particle size of less than 10 microns and preferably less than 2 microns.

The use of fine powder ensures that a fine even dispersion of the powders is obtained in the finished contact material.

A typical commercially available silver powder which can be utilized is "Thessco" silver powder produced by Sheffield Smelting Company, a subsidiary of Engelhard Industries of Great Britain. This silver powder which is a precipitated powder of commercial purity is of irregular morphology, a powder particle size of less than 300 British Standard mesh (53 microns) and an apparent density of 1.9 gms/cc. This material also has (i) a geometric means linear intercept by transmission microscopy of 17.8 microns, standard deviation 2.0 and (ii) a geometric mean linear intercept on a polished section of 4.1 microns, standard deviation 2.0. This commercially available silver powder is sieved before being used to remove the powder particles which are of a size greater than approximately 350 British Standard mesh.

The lanthanum, strontium chromite ($La_{1-x}Sr_xCrO_3$) powder can for example, be produced by spray decomposition of La, Sr and Cr nitrates in stoichiometric proportions. The oxide mixture resulting from this process is then sintered in air for approximately one-half hour at a temperature of approximately 1,250°C. The sintered powder is then milled for 96 hours under acetone in an agate planetary miller and washed in dilute hydrochloric acid. This powder is free from impurities such as strontium chromate and has a submicron powder particle size.

It is important to note that these materials should be kept clean and dry in storage in order to prevent moisture absorption and surface oxidation (this is especially important for the silver powder). The powder storage could for example be effected by the use of dessicators.

The intimate mixing of the silver and $La_{1-x}Sr_xCrO_3$ powders can be effected by dry tumble milling. In order for the dry tumble milling to be effective for these powders it is important that the following mixing conditions are adhered to:

a. The constituent powders should have a particle size as specified in a preceding paragraph.

b. The powders should be dessicator stored, or stored with some alternative means being employed of preventing absorption of moisture and surface oxidation.

c. The volume to be mixed should be from 50 grams upwards; the actual mixing time being dependent upon the size of the mix.

d. The $La_{1-x}Sr_xCrO_3$ non-metallic phase composition should be in the range 1.0 to 20 weight per cent.

e. The volume of the drum should be of the order of 2 to 10 times the volume of the powder being mixed in order to prevent the movement of the powder being restricted.

f. The relative humidity inside the drum should be in the range 0 to 70 per cent and the inside drum temperature should be in the range 10 to 30°C.

g. The speed of rotation of the drum should be such that the powders are continually in motion during mixing. Increasing the speed of rotation of the drum will decrease the time required for good mixing. If the speed of rotation is excessive, however, then, due to the influence of centrifugal forces, mixing will be hindered.

h. The duration of powder mixing is generally dependent upon the $La_{1-x}Sr_xCrO_3$ non-metallic phase content of the powder; the larger the electrically non-metallic phase content the longer the mixing time.

It should, however, be noted that the most significant variable in attaining a fine uniform dispersion of the $La_{1-x}Sr_xCrO_3$ powder throughout the contact material is the absolute and relative sizes of the constituent powder particles and the optimum mixing schedule is largely determined by this factor.

Typical mixing conditions for the silver and $La_{1-x}Sr_xCrO_3$ powders in mixing volumes in the range 50 to 1000 grams and a $La_{1-x}Sr_xCrO_3$ non-metallic phase composition in the range 1.0 to 20 weight per cent are as follows:

a. The drum volume was of the order of 2 to 10 times that of the powders being mixed.

b. The mixing was carried out at 20°C (range 17°C to 23°C) with a relative humidity of approximately 60 per cent (range 45 to 65 per cent).

c. The drum was revolved at 160 r.p.m.

d. Two 5 hour mixing periods were carried out, the powder mixture being seived, between the two mixing stages, through a sieve having apertures of approximately 45 microns.

These mixing conditions have been found for the particular powders employed to give a uniformly mixed composite powder.

The powder mixture is then compacted at a pressure of approximately 10 tons per square inch using molds into the desired shape for the electrical contacts.

The powder compacts are then sintered by being heated in air at a temperature of 930°C for a period of time of approximately 1 hour.

The processing schedule used results in some of the $La_{1-x}Sr_xCrO_3$ non-metallic material being presented at the surface of the electrical contact where it stands raised from the surface as discrete islands of a hard, chemically inert, non-metallic phase of high electrical conductivity on a silver sea.

The density of the contact material is then increased by a coining or stamping operation at a pressure of approximately 50 tons per square inch.

It should be noted that the temperature and pressure schedule of this method which produces contact compacts having a density of at least 98 per cent of the theoretical maximum density, represents the optimum schedule for the powder particle sizes outlined in the preceding paragraph. It is envisaged that this schedule, and in particular the compacting and stamping pressures, may be changed if finer powders of different morphology are utilized.

The presence of the highly conductive, non-metallic phase at the surface of the electrical contacts produced by the method according to the invention effectively minimizes the increase in contact resistance previously referred to by providing highly conductive paths across the contacting interface.

Also, the sulphide films which, as previously stated, tend to form on the silver are disrupted by the harder, chemically inert, non-metallic phase at the contact surface so that electrical contact is maintained by conducting phase to silver or conducting phase to conducting phase contact; the discrete islands of highly conductive, non-metallic material effectively constitute anisotropic conducting paths through the otherwise high resistivity sulphide film formed on the surrounding silver material.

An example of an electrical contact material produced by the method outlined in the preceding paragraphs in the form of domed electrical contacts is given below together with the associated contact resistance data. The electrical contacts were subjected to accelerated tarnishing tests conducted using pure $H_2S$/water vapor environments at a slightly reduced pressure. The atmosphere used consisted of $H_2S$ (99.6 per cent) at a partial pressure of 700 torr (93kNm$^{-2}$) and water vapor at a partial pressure of 17 torr (2.25kNm$^{-2}$). The electrical contacts were exposed to this atmosphere in the "as-coined" state or "as-coined and thermally etched" state for a period of approximately 16 hours. The thermal etching which was carried out in air for a period of approximately 10 minutes at a temperature of approximately 800°C, was employed in order to reveal high-spots of the conducting phase by the evaporation and surface diffusion of silver. The oxide is then ideally situated to penetrate sulphide films which form on the contact surface and minimizes contact resistance. All the contact resistance measurements were made across the interface between the domed contact surface and a flat polished silver reference surface.

EXAMPLE 1

Silver - 1.0 weight per cent $La_{0.7}Sr_{0.3}CrO_3$

This material, when compared with pure silver, exhibited a marked reduction in contact resistance after exposure to a tarnishing atmosphere as shown in the following table:

| State of Contact | Contact material | Contact Resistance (milliohms) at Selected Contact Forces 20gm | 50gm | 100gm |
|---|---|---|---|---|
| 'As coined' | Silver | 700 | 300 | 80 |
| | Silver - 1 weight per cent $La_{0.7}Sr_{0.3}Cro_3$ | 14 | 8 | 4 |
| 'As coined and Thermally Etched'. | Silver | 700 | 13 | 6 |
| | Silver - 1 weight per cent $La_{0.7}Sr_{0.3}CrO_3$ | 8 | 4.5 | 2.5 |

The 'as coined and thermally etched' contacts gave a significant improvement on the 'as-coined' contacts as shown by the contact resistance values given in the above table. The greatest improvements were found to occur at low contact forces; for example, at 20 grams the contact resistance of 'as-coined' thermally etched Ag-1 weight per cent $La_{0.7}Sr_{0.3}CrO_3$ is only 8 milliohms compared with 700 milliohms for pure silver.

Similar improvements in contact performance over pure silver have been observed for silver-5.0 weight per cent $La_{0.7}Sr_{0.3}CrO_3$ and silver-10.0 weight per cent $La_{0.7}Sr_{0.3}Cro_3$ electrical contacts. For example at 20 grams contact force, contacts exposed to $H_2S/H_2O$ atmospheres for 16 hours gave the following values of contact resistance against a flat polished silver reference surface.

Ag 700 milliohms

Ag - 5.0 weight per cent $La_{0.7}Sr_{0.3}CrO_3$ 11.0 milliohms

Ag - 10.0 weight per cent $La_{0.7}Sr_{0.3}CrO_3$ 19.5 milliohms

In another method according to the invention for producing a silver-based electrical contact material which includes cadmium oxide as well as the $La_{0.7}Sr_{0.3}CrO_3$ electrically conductive, non-metallic phase, the various production stages are basically the same as the method outlined in the preceding paragraphs and it is preferable to use a cadmium oxide powder of say cubic morphology and having a powder particle size of not greater than approximately one micron.

A typical commercially available cadmium oxide material that can be utilized is "Reagent Grade" cadmium oxide powder produced by Hopkins and Williams Limited of Great Britain. This powder which is produced by burning cadmium and condensing the smoke that the burning causes, is of cubic morphology and the powder particles are less than one micron. Also, on chemical analysis the powder was found to have the following composition:

| | |
|---|---|
| Cadmium oxide as CdO | 99.0% min. |
| Chloride (Cl) | 0.005% max. |
| Sulphate ($SO_4$) | 0.005% max. |
| Iron (Fe) | 0.001% max. |

-continued

| | |
|---|---|
| Potassium (K) | 0.002% max. |
| Sodium (Na) | 0.01% max. |

The minute amounts of the additional materials Cl, $SO_4$, Fe, K and Na were found to have no significant effect on the performance of the electrical contacts produced from material which included this CdO powder.

This commercially available powder should also be kept clean and dry in storage to prevent moisture absorption. The powder storage could, as previously stated, be effected by the use of dessicators.

The cadmium oxide powder is mixed with the other powder constituents to an evenly dispersed concentration in the range 2.5 to 20 weight per cent by, for example, the dry tumble milling process previously outlined, the duration of the powder mixing being also dependent on the cadmium oxide content as well as the electrically conductive, non-metallic phase content of the powder; the larger the cadmium oxide content the longer the mixing time.

When the cadmium oxide powder had an excessive moisture content and correspondingly increased tendency to aggregate it was found necessary to sieve the powder through a 350 British Standard mesh sieve after the tumbling operation and to then retumble the sieved powder mixture for a further period.

This powder mixture is then compacted at a pressure of approximately 40 tons per square inch using molds into the desired shape for the electrical contacts.

The contact compacts are then sintered, as before, by being heated in air for a period of time of approximately one hour. The upper temperature limit for the sintering operation is 767°C, i.e. the boiling point of cadmium. In order to ensure that very little cadmium oxide is lost during sintering and to preclude the need for protective atmosphere packing, a temperature below the boiling point of cadmium should be utilized, for example a temperature of the order of 700°C.

The density of this contact material can also be increased if desired, by a stamping or coining operation, at a pressure of approximately 50 tons per square inch.

This cadmium oxide containing contact material exhibits superior resistance to welding properties than sintered copper, commercially available fine silver and some sintered silver-cadmium oxide materials. Also improvements in contact performance have been observed for this material; for example, a silver-11.0 weight per cent cadmium oxide - 5.0 weight per cent $La_{0.7}Sr_{0.3}CrO_3$ electrical contact when exposed to an $H_2S/H_2O$ atmosphere for 16 hours at a contact force of 20 grams gave the following values of contact resistance against a flat polished silver reference surface in comparison to pure silver:

Ag 700 milliohms

Ag - 11.0 weight per cent CdO - 5.0 weight per cent $La_{0.7}Sr_{0.3}CrO_3$ 9.0 milliohms It is to be understood that the foregoing description of specific examples of this invention is made by way of example only and is not considered as a limitation in its scope.

What we claim is:

1. A method of producing an electrical contact material including the steps of providing irregular silver powder having a powder particle size of not greater than approximately 350 British Standard mesh; providing lanthanum, strontium chromite powder of formula $La_{1-x}Sr_xCrO_3$, where the values of x lie between 0 and 1.0, and having a powder particle size of not greater than approximately 10 microns; mixing the powders together to provide a fine, evenly dispersed mixture containing 1.0 to 20 weight per cent of $La_{1-x}Sr_xCrO_3$ and the remainder silver; compacting the powder mixture into a desired shape; and sintering the compacted shape.

2. A method as claimed in claim 1 which includes prior to the compacting and sintering steps, the steps of providing 2.5 to 20 weight per cent of cadmium oxide powder having a powder particle size of not greater than approximately one micron; and mixing the cadmium oxide powder with the silver powder and the $La_{1-x}Sr_xCrO_3$ powder to provide a fine, evenly dispersed mixture.

3. A method as claimed in claim 1 wherein the provision of the $La_{1-x}Sr_xCrO_3$ powder includes the steps of mixing La, Sr and Cr nitrates in stoichiometric proportions; spray decomposing the mixed nitrate solution to provide a mixed oxide powder; sintering the oxide powder in air; milling the sintered powder under acetone; and washing the milled powder in dilute hydrochloric acid.

4. A method as claimed in claim 2 wherein the provision of the $La_{1-x}Sr_xCrO_3$ powder includes the steps of mixing La, Sr and Cr nitrates in stoichiometric proportions; spray decomposing the mixed nitrate solution to provide a mixed oxide powder; sintering the oxide powder in air; milling the sintered powder under acetone; and washing the milled powder in dilute hydrochloric acid.

5. A method as claimed in claim 1 wherein the lanthanum, strontium chromite is of formula $La_{0.7}Sr_{0.3}CrO_3$.

6. A method as claimed in claim 2 wherein the lanthanum, strontium chromite is of formula $La_{0.7}Sr_{0.3}CrO_3$.

7. A method as claimed in claim 4 wherein the lanthanum, strontium chromite is of formula $La_{0.7}Sr_{0.3}CrO_3$.

8. A method as claimed in claim 7 wherein the sintering of the mixed oxide powder is effected for approximately one-half hour at a temperature of approximately 1,250°C.

9. A method as claimed in claim 7 wherein the milling of the sintered powder is effected for 96 hours.

10. A method as claimed in claim 5 wherein the sintering of the powder compact is effected in air at a temperature of 930°C for a period of approximately 1 hour.

11. A method as claimed in claim 6 wherein the sintering of the powder compact is effected in air at a temperature of 930°C for a period of approximately 1 hour.

12. A method as claimed in claim 8 wherein the sintering of the powder compact is effected in air at a temperature of 930°C for a period of approximately 1 hour.

13. A method as claimed in claim 3 wherein the compacting of the powder is effected at a pressure of approximately 10 tons per square inch.

14. A method as claimed in claim 5 wherein the compacting of the powder is effected at a pressure of approximately 10 tons per square inch.

15. A method as claimed in claim 2 wherein the compacting of the powder is effected at a pressure of approximately 40 tons per square inch.

16. A method as claimed in claim 3 wherein the compacting of the powder is effected at a pressure of approximately 40 tons per square inch.

17. A method as claimed in claim 5 wherein the compacting of the powder is effected at a pressure of approximately 40 tons per square inch.

18. A method as claimed in claim 1 wherein the powder mixing is effected by dry tumble milling.

19. A method as claimed in claim 2 wherein the powder mixing is effected by dry tumble milling.

20. A method as claimed in claim 1 which includes the step of coining the sintered compacts to increase the density thereof.

21. A method as claimed in claim 2 which includes the step of coining the sintered compacts to increase the density thereof.

22. A method as claimed in claim 20 wherein the coining is effected at a pressure of approximately 50 tons per square inch.

23. A method as claimed in claim 20 which includes the step of thermally etching a contact surface of the coined compacts.

24. A method as claimed in claim 23 wherein the thermal etching is effected in air at a temperature of 800°C for a period of approximately 10 minutes.

25. An electrical contact material produced by the method as claimed in claim 11.

26. An electrical contact comprising of the material as claimed in claim 25.

* * * * *